United States Patent [19]

Tomko

[11] 4,309,029

[45] Jan. 5, 1982

[54] MARTIAL ARTS STRIKING MACHINE

[76] Inventor: Steven M. Tomko, R.D. #1, Box 130-C, Auburn, Pa. 17922

[21] Appl. No.: 1,600

[22] Filed: Jan. 8, 1979

[51] Int. Cl.[3] ..... A63B 69/00

[52] U.S. Cl. ..... 272/76

[58] Field of Search ..... 272/76, 77, 78; 273/55 R, 55 A

[56] References Cited

U.S. PATENT DOCUMENTS

| | | | |
|---|---|---|---|
| D. 237,869 | 12/1975 | Siroki | 272/77 X |
| 396,938 | 1/1889 | Kemuler | 272/76 |
| 944,648 | 12/1909 | Austin | 272/77 |
| 1,679,174 | 7/1928 | Richards et al. | 272/76 |
| 3,804,406 | 4/1974 | Viscione | 272/76 |
| 3,888,481 | 6/1975 | Adams et al. | 272/76 |
| 3,927,879 | 12/1975 | Long | 272/76 |
| 4,077,624 | 3/1978 | Feaser | 272/76 |

*Primary Examiner*—Richard J. Apley
*Assistant Examiner*—T. Brown
*Attorney, Agent, or Firm*—Philip D. Freedman

[57] ABSTRACT

A striking device for training in martial arts comprises a base and at least two arc supports of differing heights, resiliently attached in a vertical plane to the base; striking area supported on the concave side of the arc supports; adjustable spacers between the arc supports to provide variable tension levels to the arc supports; and a back brace supporting the convex side of at least one of the arc supports and at a point on the convex side so as to provide maximum stable resistance.

3 Claims, 6 Drawing Figures

MARTIAL ARTS STRIKING MACHINE

FIELD OF THE INVENTION

The invention relates to a striking device for use in training in martial arts, such as boxing and karate.

DESCRIPTION OF THE PRIOR ART

Various striking devices for training in martial arts are known. For example, U.S. Pat. No. 4,077,624 teaches a striking device wherein target elements are suspended by a cord from a fixed overhead position and pivoted rod-mounted response elements are balanced between the target elements.

U.S. Pat. No. 3,927,879 teaches a punching bag, having a base for mounting on a stationary surface and a spring biased arm pivotly connected to the base and constrained to move only in a single plane with one end of the arm biased by a spring against a resilient bumper. On the other end of the arm a deformable pad is presented for striking by the fist and each time the pad is struck, the arm moves back along a lineal path against the spring bias and snaps back to its original position for repeated striking. A pair of resilient bumper elements are placed between the pivoted arm and base in spaced relation to each other. One resilient element serves to absorb kinetic energy of the pivot arm when the pivot arm is moved towards the base against the spring bias and the other resilient element serves to absorb the kinetic energy of a pivot arm when the pivot arm is moved away from the base as a result of the spring bias.

U.S. Pat. No. 3,804,406 relates to a mechanical man used as a simulated karate fighter, and U.S. Pat. No. 3,427,021 has to do with a striking device having telescopic tubes, one carrying a striking pad at its free end and the other being mounted on a base attachable to a supported surface.

The study of the martial arts has grown rapidly in the past years. Now there are many participants of varying ages-- both male and female. Because of this great variety of participants, there is a great variety in the size, shape, and weight of the students of the arts. None of the prior art devices has been designed to accommodate this variety of users. The present invention is so designed in that it has both higher and lower striking surfaces which may be tension adjusted.

SUMMARY OF THE INVENTION

The present invention involves a striking device which has the capability of being used by students of the martial arts who are of a variety of size and strengths. Additionally, the device may be used for numerous defensive strokes, such as punching, striking, and kicking. The striking device of the present invention comprises a base and at least two arc supports of differing heights, resiliently attached in a verticle plane to the base; striking areas supported on the concave side of the arc supports; adjustable spacers between the arc supports to provide variable tension levels to the arc supports; and a back brace supporting the convex side of the last of the arc supports away from the striking areas and at a point on the convex side so as to provide maximum stable resistance.

FIG. 5 is a section taken along the line 5—5, revealing a section of one of the adjustable spacers.

Figure 1:
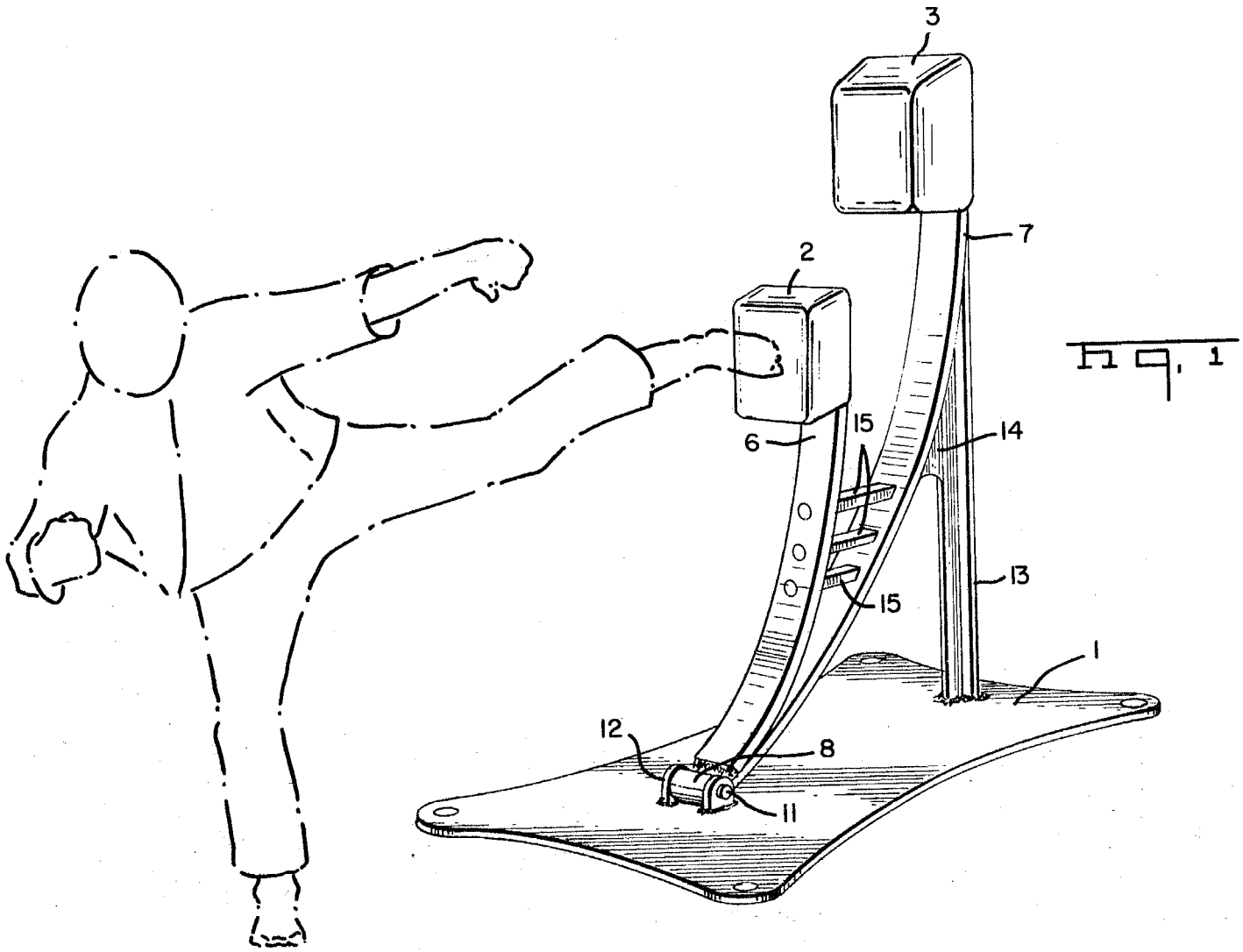
FIG. 1 is a perspective view of the striking device which is the subject of the present invention and additionally shows in phantom a practitioner of the martial arts using the striking machine.
Figure 3:
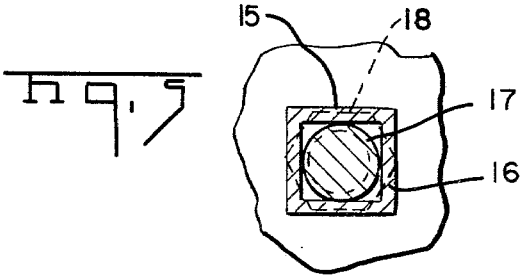
FIG. 3 is a section view of an arc support.
Figure 4:
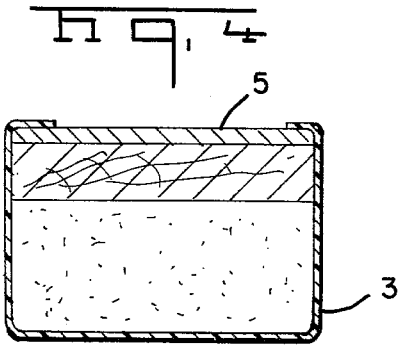
FIG. 4 is a striking surface showing a padded area in a wood foundation.
Figure 7:
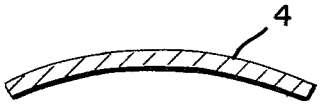
Figure 2:
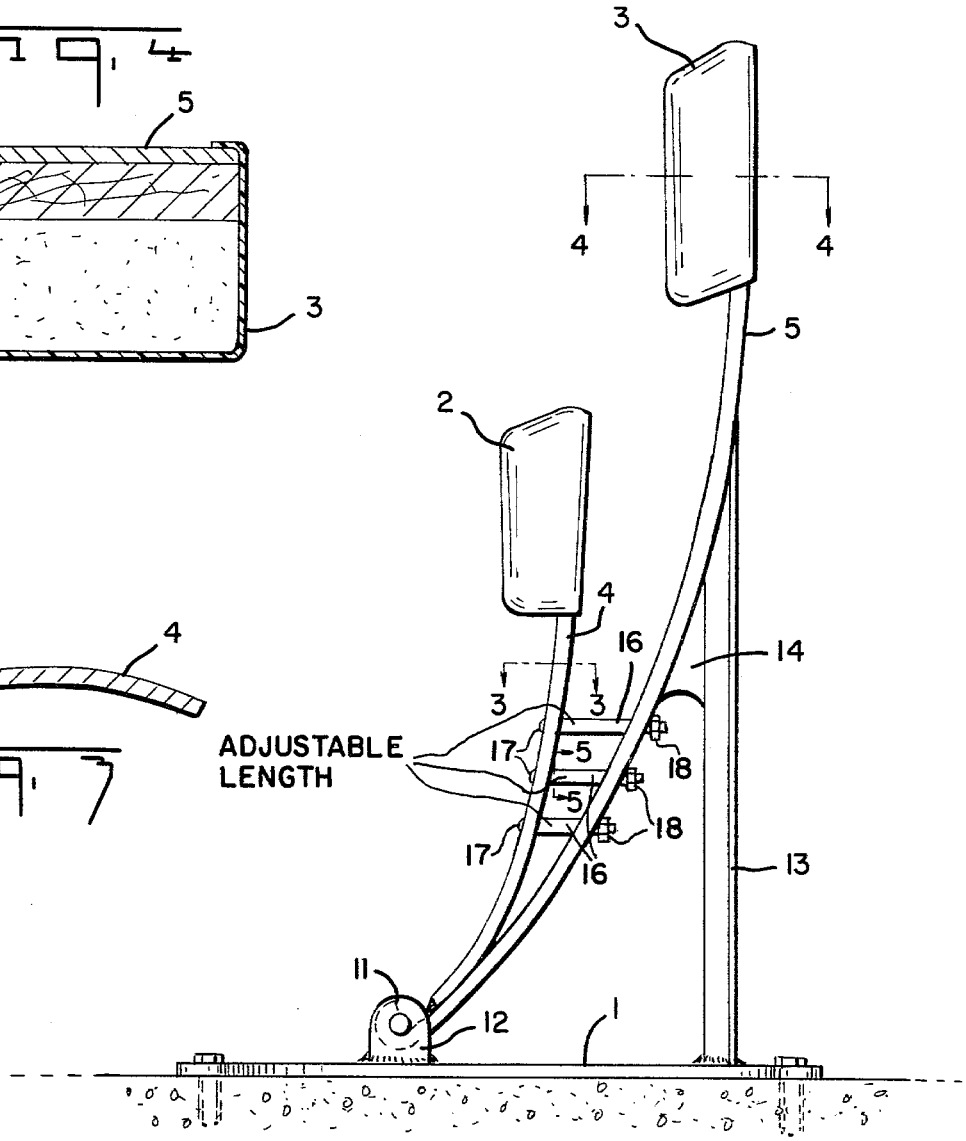
FIG. 2 is a side elevation of the striking device.
Figure 6:
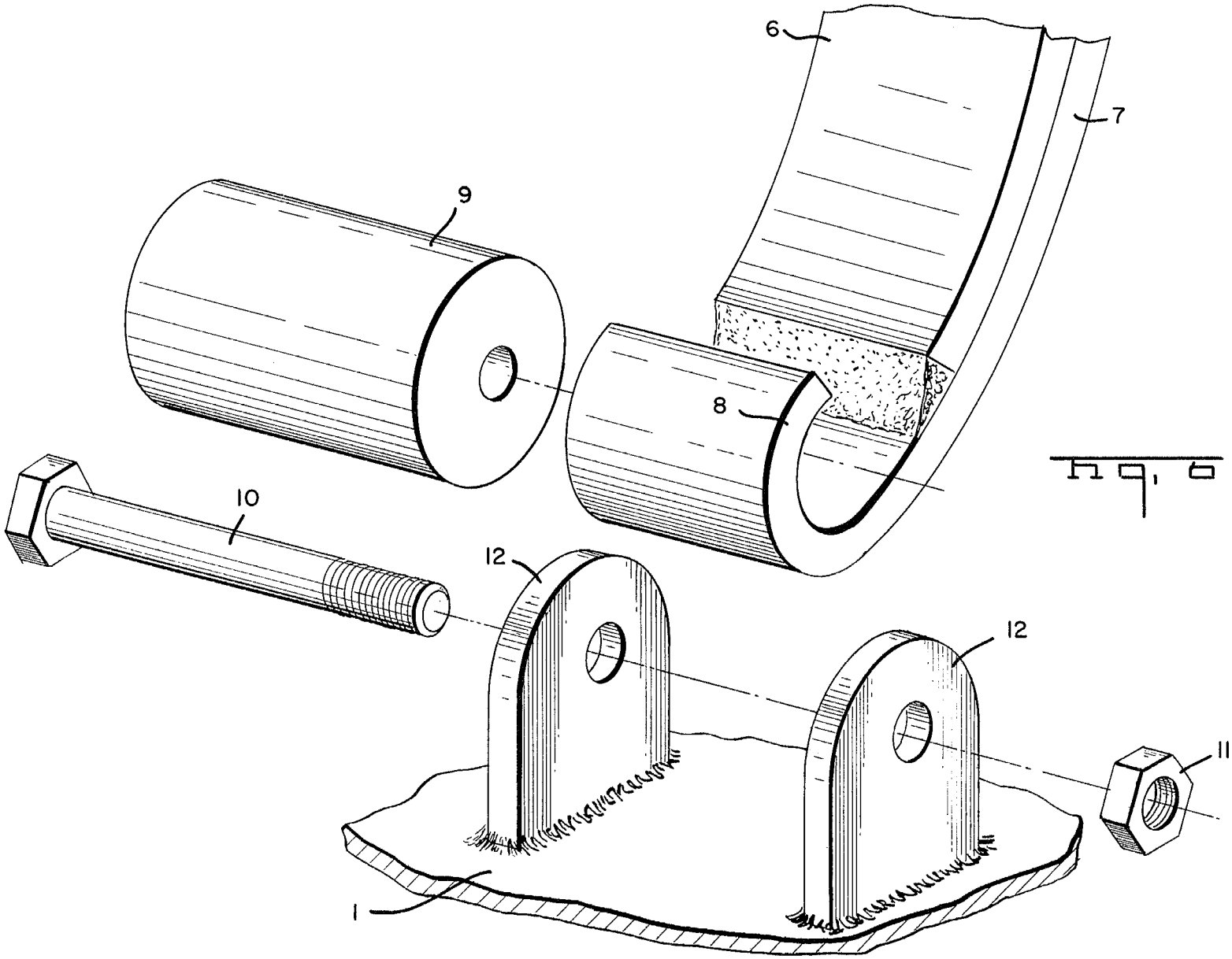
FIG. 6 is a perspective view of the rotatable connection of the main steel support of the base plate.

In FIG. 1, a striking machine is shown supported on a base plate 1 which may be mounted on a hardwood or concrete floor or to any flat surface. Shown are the striking surfaces of the device. As shown more in detail in FIG. 4, these areas consist of foam padding 2 (not shown) and 3 attached to a wood foundation 4 (not shown) and 5. The striking surfaces are attached respectively to steel supports 6 and 7 in the shape of an arc. The supports consist of two flat tempered pieces of steel each having a permanent tempered arc. The longer of these pieces is "curled" 8 at its end. This provides an accommodation as shown in FIG. 6 for a pressed rubber bushing 9. The curl and bushing are then inserted into the base plate housing 12 and secured by a bolt 10 and nut 11. The steel arc support 7 is further supported by gusset 14 which is fitted between the steel support 7 and back brace 13, which runs from the base plate 1 adding further stability to the machine. Adjustable spacers 16 are provided between the two arc-spaced steel supports 6 and 7. It is particular advantage of the present invention that the providing of these spacers permits the adjusting of the machine to differing tension levels to provide for the proper striking resistance for the particular user. Although the drawing shows a striking machine with three adjustable spacers, any number may be used—the more spacers provided, the more delicately the machine can be adjusted. The spacers 16 as shown in FIG. 5 may consist of bolts 17 secured by nuts 18 (not shown), through square outertubing 15.

Some of the particular advantages of the striking machine of this invention are that the supports are of a particular shape—the flat tempered arc shape, which in their utilization in the machine provide desired resistance to attack, properly absorbing a strike. Another advantage is the providing of the adjustable spacers which permit use by a student of the martial arts regardless of his stage of training.

The following is a description of a particular machine of the present invention. This machine is exemplary only. The machines of this invention may be of a variety of sizes. The base plate 1 is provided with holes to accommodate screws or bolts for the attachment to the floor. The steel supports 6 and 7 consist of two flat tempered pieces of steel, one approximately 58 inches high by two and a half inches wide by a quarter inch thick with a permanent tempered arc of five inches at its center and having a curl 8 at its end two inches in diameter. The pieces additionally have a pressed rubber bushing two inches in diameter and three inches in length with a quarter inch wall thickness inserted into the curl which in turn is connected into the base housing 12 and secured by a half inch by four inch bolt 10 and nut 11. The other steel support 6 is forty-two and one-half inches in height by two and a half inches wide by a quarter inch thick and has a permanent arc of five inches at the center and is welded to steel support 7 at a point above the connection at housing 12. Striking surfaces 2 and 3 consist of foam padding two and a half inches in thickness permanently glued to finished oak wood bases 5, twelve and a half inches by four and a half inches by three quarter inch in size. The foam padding and oak wood base is covered by vinyl covering.

Steel housing 12 contains the curled end 8 of the steel support 7. The housing is three and a half inches in height and three and a half inches wide and four and a half inches long and is permanently welded to the base plate.

The back brace 13 is an angle iron thirty-four and one-half inches high and one and a half inches by one and a half inches by a quarter inch in size. It is also permanently welded to the base plate. The gussett 14 is a piece of steel eleven inches by a quarter inch in size and fasten to contour to the back brack and the back of the larger 7 of the steel arc supports. The gusset provides added structural strength and increased resistance to striking. The adjustable spacers 16 are made of square tubing one inch by one inch and containing three-eighth inch bolts 17 and secured by nuts 18 connecting the lower steel arc support 6 to the upper 7. Three adjustable spacers 16 are shown in connection with the machine illustrated in the drawings. Respectively the spacers separate the supports by 2, 3 and 4 inches. The lower spacer is eleven inches high, the second, sixteen inches and the third twenty-one and one-half inches from the base plate 1.

What is claimed is:

1. A striking device comprising a base; at least two arc supports of differing heights, resiliently attached in a vertical plane to said base; striking areas supported on the concave side of the arc supports; adjustable spacers between the arc supports to provide variable tension levels to said arc supports; and a back brace supporting the convex side of at least one of the arc supports and at a point on the convex side so as to provide maximum stable resistance.

2. The striking device of claim 1, having two arc supports of differing heights, with three adjustable spacers between the arc supports to provide variable tension levels to said arc supports.

3. The striking device of claim 1, having two arc supports of differing heights, with three adjustable spacers between said arc supports to provide variable tension levels.

* * * * *